United States Patent [19]

Hummel

[11] 4,040,732

[45] Aug. 9, 1977

[54] PHOTOCONDUCTOR BELT AND DRUM ARRANGEMENT FOR PHOTOCOPYING APPARATUS

[75] Inventor: Wolfgang Hummel, Mainz-Kastel, Germany

[73] Assignee: Hoechst Aktiengesellschaft, Frankfurt am Main, Germany

[21] Appl. No.: 662,275

[22] Filed: Feb. 27, 1976

[30] Foreign Application Priority Data

Mar. 3, 1975 Germany ..... 2509117

[51] Int. Cl.[2] ..... G03G 15/00

[52] U.S. Cl. ..... 355/3 R; 355/16; 355/133

[58] Field of Search ..... 355/3 DR, 3 R, 16, 133, 355/3 BE; 101/415.1

[56] References Cited

U.S. PATENT DOCUMENTS

| | | | |
|---|---|---|---|
| 3,022,728 | 2/1962 | Heller | 101/415.1 |
| 3,588,242 | 6/1971 | Berlier | 355/16 |
| 3,757,690 | 9/1973 | Skiera et al. | 101/415.1 |
| 3,834,808 | 9/1974 | Takahashi et al. | 355/3 DR |
| 3,867,026 | 2/1975 | Ogawa | 355/16 X |

*Primary Examiner*—Richard L. Moses
*Attorney, Agent, or Firm*—Bacon & Thomas

[57] ABSTRACT

Disclosed is an electrophotographic copying apparatus comprising a cylindrical drum member having a circumferential wall and an aperture in the circumferential wall and a photoconductor belt having two end sections and covering the outer face of the circumferential wall, passing through the aperture to extend into the drum to form a seal for the aperture, and being secured within the drum, wherein one of the end sections is attached to a means for maintaining tension in the belt and the other end section is attached to a fixed member within the drum. The drum may also have end walls for attachment to the one or more fixed members within the drum.

15 Claims, 4 Drawing Figures

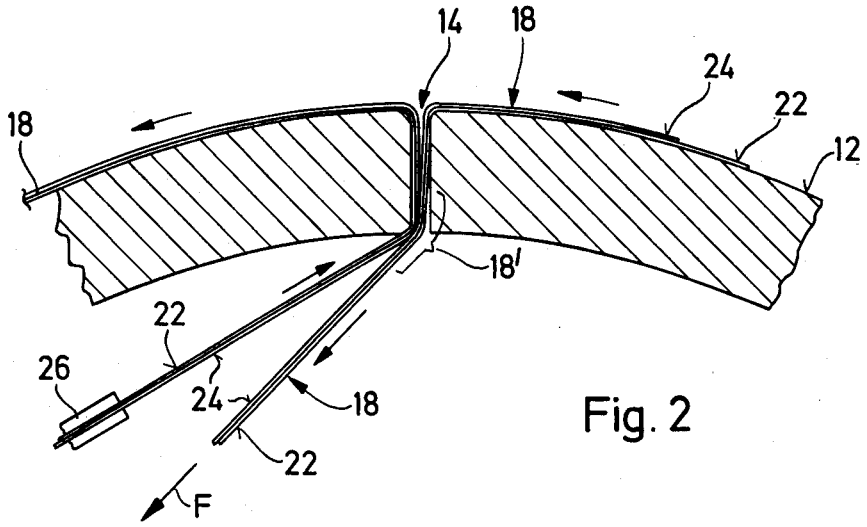
Fig. 2
Fig. 3
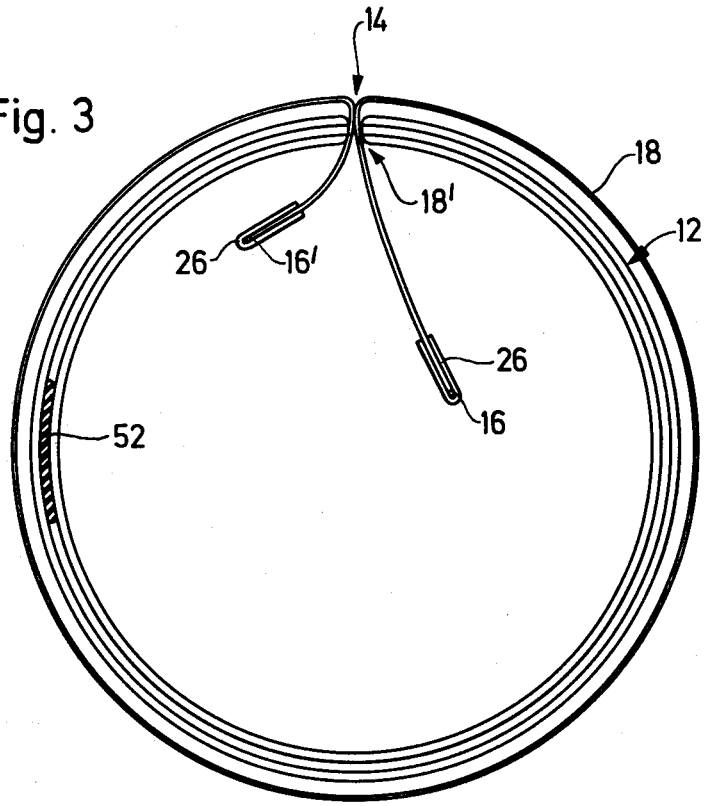

PHOTOCONDUCTOR BELT AND DRUM ARRANGEMENT FOR PHOTOCOPYING APPARATUS

BACKGROUND OF THE INVENTION

1. Field of the Invention

This invention relates to an apparatus comprising a photoconductor belt guided around a drum for an electrophotographic copying apparatus, more especially to an apparatus with a replaceable, photoconductor belt guided around a revolvable drum in an electrophotographic copying apparatus, which belt extends through an aperture in the shell or circumferential wall of the drum parallel to the axis of the drum and over the periphery thereof and also extends through this aperture into the interior of the drum.

2. Description of the Prior Art

In German published application No. P 20 01 550.3, an electrophotographic copying apparatus has been proposed having a cylindrical drum in the interior of which there are arranged a supply roller and a take-up roller for an organic photoconductor belt. Between the take-up roller and the apparatus there is a gear unit which, when it is engaged, brings about as a result of the rotation of the drum a rotation of the take-up roller which transports the photoconductor belt relative to the drum. In this apparatus, the need for a drive motor in the drum to transport the photoconductor belt is dispensed with since the photoconductor belt is transported by the rotation of the drum via the gear unit.

Another type of copying apparatus is shown in German examined and published application No. 1 522 151, wherein a surface coated with light-sensitive material is guided from a feed spool arranged inside the drum through slots onto the outer side of the drum and from there back again to a take-up spool likewise provided inside the drum. A coupling is provided in this between the take-up spool and its drive shaft which may be actuated via a rod.

In other proposed constructions, difficulties occur in sealing the apertures on the periphery of the drum through which the photoconductor belt is guided out of the interior of the drum and then back again into the drum. To overcome these problems, complicated closure members are provided for the apertures arranged on the shell of the drum, the apertures generally being in the form of slots. These closure members are matched very precisely to the curvature of the shell of the drum and protect the interior of the drum against penetration of developer material. Because of the accurate matching of the closure member to the shell of the drum and of the need for a good sealing of the interior of the drum, they are of complex construction and require accurate manufacturing processes.

A further drawback of many known devices is that the closure members require additional space for installation so that not all the periphery of the drum is available for copying purposes.

SUMMARY OF THE INVENTION

It is an object of the present invention to provide an electrophotographic copying apparatus that avoids the problems encountered by the prior art devices by eliminating the complicated closure members, drive motors, and gear units.

It is also an object of the present invention to provide an electrophotographic copying apparatus having a replaceable photoconductor belt covering a revolvable drum member.

It is yet another object of the present invention to provide an improved sealing means for a revolvable drum in an electrophotographic copying apparatus.

The present invention therefore provides an electrophotographic copying apparatus comprising a drum having, in the circumferential wall thereof, an aperture parallel to the axis of the drum, the outside face of the wall being covered by a photoconductor belt, both ends of which are secured within the drum, a first end being attached to a means for maintaining tension in the belt, the sections of the belt passing through the aperture being positioned against one face of the aperture to form a seal. Advantageously, the width of the aperture is from 2 to 3 times the thickness of the belt. The invention also provides a drum suitable for use in the device, designed to receive a belt.

This device mitigates the problem of sealing the aperture in the shell of the drum through which the photoconductor belt enters and leaves, there being no necessity for a separate closure member to seal off this aperture. There is a saving of space owing to the absence of the closure piece. Furthermore, only one aperture needs to be provided in the circumferential wall. Additionally, the present invention enables the photoconductor belt to be replaced more easily and in a shorter period of time.

The tensioning means may advantageously comprise a shackle for attachment to the first end section of the belt; one or more tension cables, preferably two, each having a first and second cable end, the first cable end being attachable to the shackle; one or more helical springs, preferably two, each having a first and second spring end, the first spring end being attachable to the second end of the cable; and a tensioning crank for attachment to the second spring end. The tension cables are advantageously guided around an elongate member positioned parallel to the axis of the drum. This arrangement enables the end sections of the belt to be forced together and pressed against one side of the aperture opening, thereby sealing the aperture. By way of the tensioning means the photoconductor belt may always be adequately tensioned in a simple manner to form an adequate seal and to enable the belt to lie against the shell of the drum without the formation of folds.

A preferred arrangement of the tensioning crank is to mount it on two bearing brackets so that it can move around two pivot pins. Advantageously, the tensioning crank has a round bar or shaft around which the ends of the helical springs may be hooked and which in its extreme position lies on a cross member. The tensioning crank tensions the photoconductor belt, advantageously upon rotation in the clockwise direction, in that the round bar describes with the ring at the end of the spring, a sector of a circle around the pivot pins. By this arrangement, the tensioning crank may be rotated with, for example, the aid of a box spanner which is placed upon a pivot pin, thereby putting the photoconductor belt under tension.

Preferably the sections of the photoconductor belt diverge from one another at an acute angle after they have passed through the aperture in a chordal direction into the interior of the drum. Inside the drum an angle of from 70°–120° is formed by the tension cables as they are guided around the elongate member under the tension applied by the tensioning means to the first end of the photoconductor belt. This angle assures the effective sealing of the aperture by the pressing of the two belt end sections together and against one face of the aperture.

Additional elongate members and fixed members may be arranged within the drum for various advantageous embodiments of the invention. In one preferred embodiment the fixed member, as well as the elongate member, are of substantially the same length as the cylindrical wall of said drum member. These fixed and elongate members advantageously have threaded holes at each end thereof and when properly fitted and aligned with end members for the drum may constitute a mounting means for all interior components of the drum. Accordingly, the drum remains capable of revolving movement. It is, of course, desirable to provide a seal between the drum ends and the cylindrical drum wall and any of the conventional sealing arrangements may be considered for the present invention.

Other embodiments are possible and will be apparent to the artisan but the foregoing, and especially the description of the preferred embodiments which follow, are intended to set forth the best mode of the present invention. However, it is not intended that the invention be construed as limited to these embodiments for there are, of course, numerous possible variations and modifications.

DESCRIPTION OF THE PREFERRED EMBODIMENTS

One form of device constructed in accordance with the invention will be described in greater detail by way of example only, by reference to the accompanying drawings, in which:

FIG. 2 shows an enlarged partial view of a detail II according to FIG. 1;

FIG. 3 shows a shematic view of the drum as the photoconductor belt is being inserted.

Figure 1:
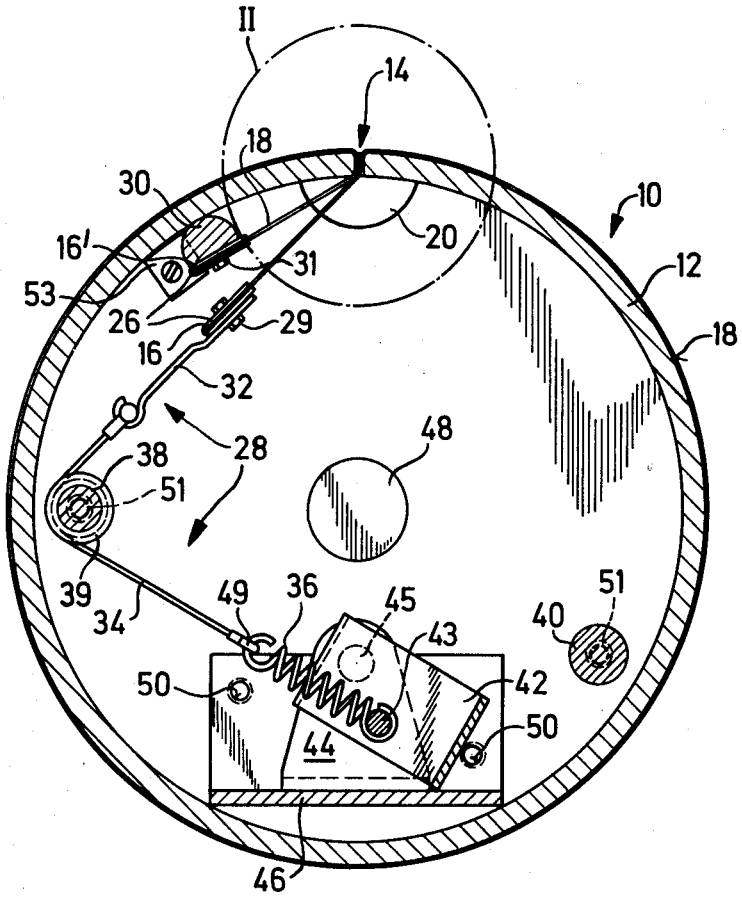
FIG. 1 is a cross-section along the line I—I in FIG. 4 of a drum with a tensioning device.
Figure 4:
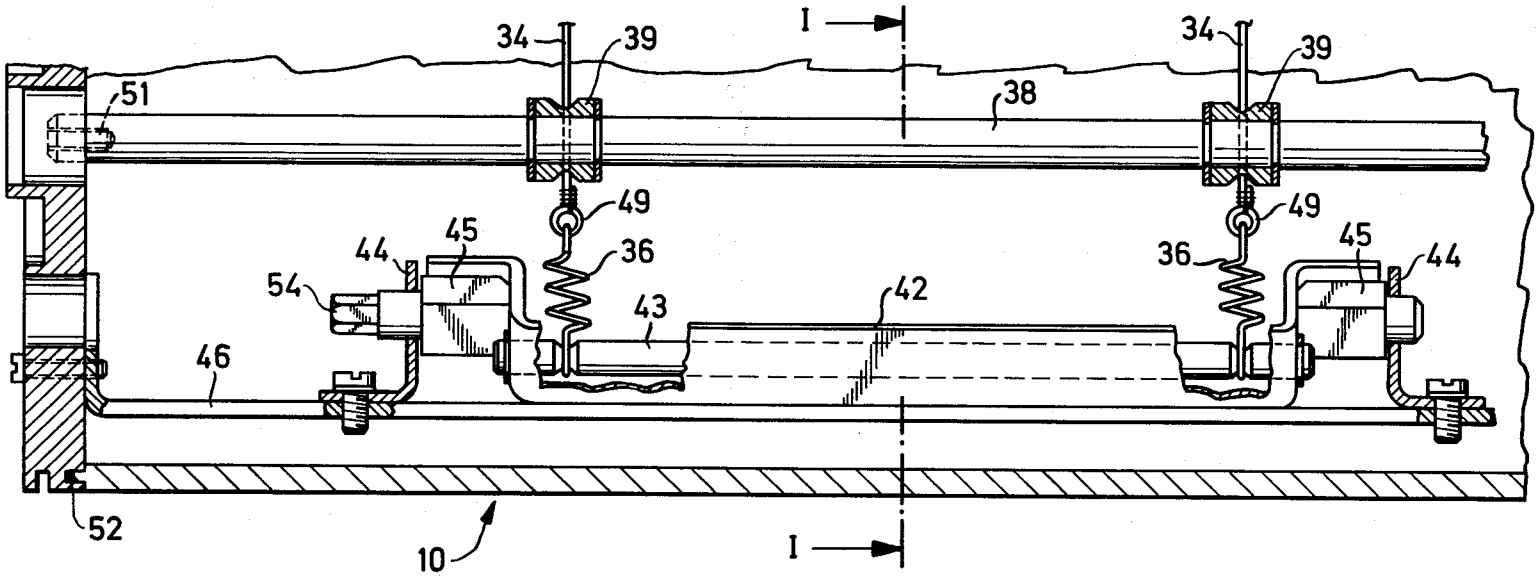
FIG. 4 shows an axial section of the drum with tensioning device.

Referring now more especially to FIGS. 1 and 4, the shell or outer circumferential wall 12 of a drum 10 has an aperture 14 in the form of a slot which extends in the longitudinal direction i.e. parallel to the axis of the drum 10. A photoconductor belt 18 consists, for example, of an aluminized carrier film 22 of plastic material and, for example, of an organic photoconductor 24. The width of the aperture 14 in the shell 12 of the drum 10 is preferably double the thickness of the belt 18. By selection of the aperture width, two thicknesses of the photoconductor belt 18 can be inserted simultaneously into the drum 10 without difficulty, and sections 18′ of the photoconductor belt 18 fill up the width of the aperture to a great extent and seal off the inner space of the drum 10 from developer mixture which is, for example, cascaded onto the photoconductor belt 18. The ends 16, 16′ of the photoconductor belt 18 are each gripped, so that they cannot be torn out, in hollow metal cleats, 26. The length of the belt 18 is matched to the diameter of the drum and to the length of a tensioning device 28 in such a manner that the belt 18 always lies taut against the shell 12 of the drum 10 without the formation of any folds. The first end 16 of the photoconductor belt 18 is fastened to the tensioning device 28, while the other end 16′ of the photoconductor belt 18 is securely attached to a first cylindrical part 30. The tensioning device indicated generally by the reference numbers 28 consists of a shackle 32, to which one of the ends of the photoconductor belt 18 gripped by the hollow metal cleat 26 is attached by means of bolts 29. The other end of the shackle 32 is linked to tension cables 34 which are guided around a second cylindrical part 38. The ends of these tension cables 34 are shaped as terminal shackles 49 into which the helical springs 36 are hooked. The tensioning device 28 also comprises a tensioning crank 42 which is mounted in two bearing brackets 44 with two pivots pins 45. The outer pivot pin 45 shown in FIG. 4 has a hexagonal head 54, for example, onto which a box spanner may be placed in order to turn the tensioning crank 42 in a clockwise direction, to put the photoconductor belt 18 under greater tension.

The bearing brackets 44 are secured to a cross member 46 inside the drum 10. A round bar or shaft 43 spans the two arms of the tensioning crank 42 and serves to hook the spiral springs 36 into the tensioning crank 42. Upon rotation of the tensioning crank 42 around the pivot pins 45, the tension in the spiral springs 36 becomes greater and they pull the photoconductor belt 18 more taut as the round bar 43 describes a sector of a circle around the pivot pins. The cross member 46 serves during this as a stop for the tensioning crank 42. The stop is so arranged that as the crank 42 rotates the round bar 43 beyond dead center, the tensioning device 28 is prevented from springing back. The springs 36 thus draw the tensioning crank 42 automatically towards the cross member 46 acting as stop.

The sections 18′ of the photoconductor belt 18 entering the interior of the drum 10 through the aperture 14 have a sloping path, as shown in FIG. 2, and diverge at an acute angle after leaving the aperture 14. In the extension of the first end 16 of the photoconductor belt 18, there is then a tension F throughout the cable 34. The angle of grip of the cables 34 around the second cylindrical part 38 lies between 70° and 120°, the cables 34 being guided around small rollers 39 which are situated at a distance from one another on the second cylindrical part 38. The second cylindrical part 38 is arranged at a slight distance from the shell 12 of the drum on the horizontal passing through the drum shaft 48.

Owing to the sloping or chordal path of the belt 18 after its passage through the aperture 14 into the interior of the drum 10, the sections 18′ lie against one inner edge of the aperture 14 to form a seal. Further sealing is obtained because the width of the aperture 14 corresponds approximately to two to three times the thickness of the belt 18, so that the width of the aperture is largely filled by the belt 18.

Clearly the tension F necessary to tension the belt 18 can be achieved by appropriate selection of the helical springs 36.

The first cylindrical part 30 is prevented from rotating by a notch on one side, in which a small plate 53 engages. The other gripped end 16′ of the photoconductor belt 18 is secured to the first cylindrical part 30 by bolts 31 or by other means.

FIG. 3 shows the insertion of the photoconductor belt 18 with the front faces of the drum removed. It can be seen that only the sections 18′ of the belt 18 are inserted together through the aperture 14 extending over the entire width of the drum 10. As a result the belt 18 is placed as a loose loop around the shell 12 of the drum and then the hollow metal cleats 26 of the first end 16 and the other end 16′ of the belt 18 are fastened to the tensioning device 28 and to the first cylindrical part 30, respectively. After this, the front walls, not shown, are replaced and joined, for example by screws, to the two cylindrical parts 30 and 38 and to a third cylindrical part 40. This third cylindrical part 40 is arranged on the opposite side of the axis to the two cylindrical parts 30 and 38 at a small distance from the shell 12 of the drum 10. Like the other cylindrical parts, it too has a threaded hole 51 so that the front faces of the drum 10 may be secured to them using screws.

The cross member 46 is provided with threaded holes 50 which serve to fasten it to the lower front face of the drum with the aid of screws (not shown). Seal members 20 are provided in the front faces of the drum 10 in the area around the apertures 14 to seal off the latter in the longitudinal direction of the drum 10. Along the periphery of the drum there are also provided in the area around the front faces seal members 52 of resilient sealing material, for example, rubber.

Although the tensioning devide described above and graphically shown in the drawing at FIG. 4 demonstrates the use of two tension cables 34 and helical springs 36 attached to opposite ends of the cylindrical bar 43, it is contemplated that a plurality of springs, or even a single cable and spring, could be employed in the apparatus substantially as described above.

What is claimed is:

1. An electrophotographic copying apparatus comprising a cylindrical drum member having a circumferential wall and an aperture in said circumferential wall, and a photoconductor belt having first and second end sections, said belt covering the outer face of said wall, said belt passing through said aperture having a width of between 2 and 3 times the thickness of said belt and extending into the inner space defined by said circumferential wall to form a seal for said aperture by pressing together under tension against the face of said aperture, said end sections being secured in said inner space, the first of said sections being attached to a means for maintaining tension in said belt and the second of said end sections being attached to a fixed member within said drum.

2. An electrophotographic copying apparatus comprising a cylindrical drum member having a circumferential wall and an aperture in said circumferential wall, and a photoconductor belt having first and second end sections, said belt covering the outer face of said wall, said belt passing through said aperture and extending into the inner space defined by said circumferential wall to form a seal for said aperture, said end sections being secured in said inner space, the first of said end sections being attached to a tensioning means comprising a shackle for attachment to said first end section of said belt; a tension cable having a first and second cable end, said first cable end being attachable to said shackle; a helical spring having a first and second spring end, said first spring end being attachable to said second end of said cable; and a tensioning crank for attachment to said second end of said spring.

3. The apparatus as defined in claim 2, wherein said tensioning means contains one or more additional tension cables and helical springs attachable to said belt and said crank.

4. The apparatus as defined in claim 3, wherein said cables are guided around an elongate member which is positioned parallel to the axis of said drum.

5. The apparatus as defined in claim 4, wherein said cables are guided around said member on rollers spaced apart.

6. The apparatus as defined in claim 3, wherein said crank is pivotally mounted on pins supported on bearing brackets mounted on a cross member parallel to the axis of said drum.

7. The apparatus as defined in claim 6, wherein said cross member, parallel to the axis of said drum, serves as a stop for said tensioning crank.

8. The apparatus as defined in claim 6, wherein said crank is provided with a circular shaft for cooperation with said helical spring.

9. The apparatus as defined in claim 8 wherein, on rotation of said crank in one direction, said shaft describes a sector of a circle around said pivot pins to increase the tension on said spring.

10. The apparatus as defined in claim 4, wherein said end sections of said belt diverge at an acute angle from said aperture.

11. The apparatus as defined in claim 4, wherein the portions of said cables passing around said elongate member form an angle of between 70° and 120°.

12. The apparatus as defined in claim 2, wherein said fixed member is elongate and is positioned close to said circumferential wall of said drum.

13. The apparatus as defined in claim 12, wherein a second fixed member, which is elongate in a direction parallel to the axis of said drum, is positioned close to said circumferential wall of said drum and approximately diametrically opposite to said first fixed member.

14. The apparatus as defined in claim 2, wherein said fixed members and said elongate member are substantially equal in length to the length of said circumferential wall and are parallel to the axis of said circumferential wall, and the ends of said fixed and elongate members are provided with threaded holes whereby end walls for said drum may be attached to said fixed and elongate members by screws.

15. A drum for an electrophotographic copying apparatus comprising a cylindrical drum member having a circumferential wall and an aperture in said circumferential wall for passage of a photoconductor belt into said drum; a wall at each end of said circumferential wall in sealing relationship to said circumferential wall; a plurality of elongate members substantially equal in length to said circumferential wall and parallel to the axis of said circumferential wall, said elongate members being attached to said end walls to provide elongate places of attachment and elongate guides for said photoconductor belt inside said drum; and a tensioning crank mounted on one of said elongate members and capable of rotational motion about an axis parallel to axis of said circumferential wall to provide tensioning in said photoconductor belt.

* * * * *